US005191818A

United States Patent [19]

Mantovan et al.

[11] Patent Number: 5,191,818

[45] Date of Patent: Mar. 9, 1993

[54] PROCESS AND FACILITY FOR SHEARING TO LENGTH STEEL BARS COMING FROM A ROLLING MILL

[75] Inventors: Gianfranco Mantovan, Busto Arsizio; Gianfranco Fay, Milan, both of Italy

[73] Assignee: Pomini Farrel S.p.A., Varese, Italy

[21] Appl. No.: 847,887

[22] Filed: Mar. 10, 1992

Related U.S. Application Data

[63] Continuation of Ser. No. 556,295, Jul. 20, 1990.

[30] Foreign Application Priority Data

Jul. 31, 1989 [IT] Italy ..... 21398 A/89

[51] Int. Cl.[5] ..... B21B 43/04

[52] U.S. Cl. ..... 83/27; 83/37; 83/102; 83/105; 83/170

[58] Field of Search ..... 83/23, 102, 37, 27, 83/105, 343, 150, 24, 170, 210; 414/745.7, 746.6, 746.7

[56] References Cited

U.S. PATENT DOCUMENTS

| | | | |
|---|---|---|---|
| 1,784,556 | 12/1930 | Townsend et al. | 83/210 |
| 3,206,002 | 9/1965 | Hartenstein et al. | 414/746.6 |
| 4,399,727 | 8/1983 | Omori et al. | 83/37 |
| 4,406,198 | 9/1983 | Pechau et al. | 83/170 |

FOREIGN PATENT DOCUMENTS

| | | | |
|---|---|---|---|
| 0093886 | 10/1962 | Denmark | 414/745.7 |

*Primary Examiner*—Frank T. Yost
*Assistant Examiner*—Allan M. Schrock
*Attorney, Agent, or Firm*—Hedman, Gibson & Costigan

[57] ABSTRACT

Apparatus and process for shearing to length steel bars coming from a rolling mill in which the rolled product is continuously fed to the first of a plurality of stepped collecting chambers, of a braking/distributing apparatus which brakes and distributes the sheared bars and in phase to the stepped chambers by shearing to length a first bar and introducing the leading end of a second bar, following the first bar, to a second collection chamber; shearing to length said second bar and, by means of the shifting of said collection chambers, discharging said first, braked bar onto conveyor means.

5 Claims, 11 Drawing Sheets

PROCESS AND FACILITY FOR SHEARING TO LENGTH STEEL BARS COMING FROM A ROLLING MILL

FIELD OF THE INVENTION

The present invention relates to a process and a facility for shearing to commercial length steel bars coming from a rolling mill, wherein the term "bars" which are rolled by means of a continuous rolling process, products of varying cross-sections.

BACKGROUND OF THE INVENTION

Rolling mills for rolling steel bars are known in the art, which downstream the last rolling stand shearing means are provided in order to shear the rolled material to a length which is a multiple of the commercial length, and is generally comprised within the range of from 40 to 100 meters.

Therefore in a traditional rolling mill—whether of the type in which a natural air cooling is provided for the rolled material, or in which a forced on-line cooling is provided—downstream of the last rolling stand a shear is positioned, which performs the task of shearing the bar to a length which is a multiple of the commercial length. Downstream of said shear a feed table is provided, which feeds the sheared bars to a cooling bed having such a length as to enable the sheared bar material to be braked by exploiting the natural friction of the same material with the plane along which it slides; said length is generally comprised within the range of from 35 to 60 meters, as a function of the maximum rolling speed.

Downstream of the feed table, the cooling bed is installed, which has a length comprised, as said, within the range of from 40 to 100 meters, and a width of from 8 to 12 meters.

When they leave the cooling bed, the bars are fed through a roller apron to a shear wherein the simultaneous shearing takes place of a plurality of cold bars to commercial length (said length is generally comprised within the range of from 8 to 24 meters).

Then apparatuses follow, which perform the tasks of forming the bundles, tying and subsequently discharging said end bar bundles to the material storage.

This type of facility suffers from the drawbacks that it occupies a considerably large surface-area, with a length between the finishing stand and the end of the cooling bed, which is comprised within the range of from 75 to about 160 meters, of implying a considerable burden for sheds, foundations, machines, installed powers and staff, and consequently with extremely high operations and maintenance costs.

Furthermore, rolling mills are known in which the bars, sheared to a length multiple of the commercial length by means of a shear installed downstream the finishing stand, are selectively fed to channel-shaped chambers of apparatuses which feed the same bars—while simultaneously cooling them—to the subsequent operating units.

Equipment of this kind is disclosed and illustrated, e.g., in European patent application No. 114,791, filed on Jan. 17th, 1984 to the name of Danieli & C. Officine Meccaniche S.p.A..

Same kind of equipment, although reducing the overall dimensions of the rolling mill, has not been shown to be capable of receiving the bar already sheared to commercial length, in that the required braking cycle would be too long. Furthermore they can process only a limited range of bar diameters.

The general purpose of the present invention is of obviating the above listed drawbacks which can be observed in facilities of the type known from the prior art, by providing a facility for shearing to length rolled bars, which is so conceived, as to occupy a minimal room as compared to the facilities known from the prior art.

SUMMARY OF THE INVENTION

In order to achieve said purpose, according to the present invention, the present applicant provides a process for cutting to length steel bars coming from a rolling mill, which comprises the steps of:

feeding the continuous rolled product to a first collecting chamber, which is a part of a braking/distributing apparatus, which brakes and distributes the sheared bars and comprises a plurality of said chambers, which are stepwise mobile in sequence, in phase with the shearing of the bars;

shearing to length a first bar and introducing the leading end of a second bar, following the first bar, to a second collection chamber; and shearing to length said second bar and, by means of the shifting of said collection chambers, discharging said first, braked bar onto conveyor means.

A facility for practicing the above exposed process is characterized in that it comprises, in combination:

at least one rotary shear (10), for shearing to commercial length the bar (17) exiting the rolling mill, and a braking/distributing apparatus (11) which is suitable for receiving the sheared bars and discharging them onto conveyor means which perform the task of sending said bars to downstream processing units.

Said apparatus (11) can be structurally constituted, e.g., by a plurality of stepwise revolving coaxial drums (13) whose revolution steps take place in phase with the shear (10), with each drum being provided with circumferential chambers (16) suitable for receiving the bars (17) sheared to commercial length and for discharging them onto said conveyor means, wherein braking means (20) for braking said bars (17) cooperate with said drums (13), which braking means (20) face the interior of said chambers (16).

The structural and functional characteristics of the present invention and its advantages over the technique known from the prior art will be better understood from the following disclosure, made by referring to the hereto attached schematic drawings, which show an example of a facility constructed according to the innovative principles of the same invention.

FIGS. from 7 to 10 show the different operating steps of the shear; and

Figure 11:
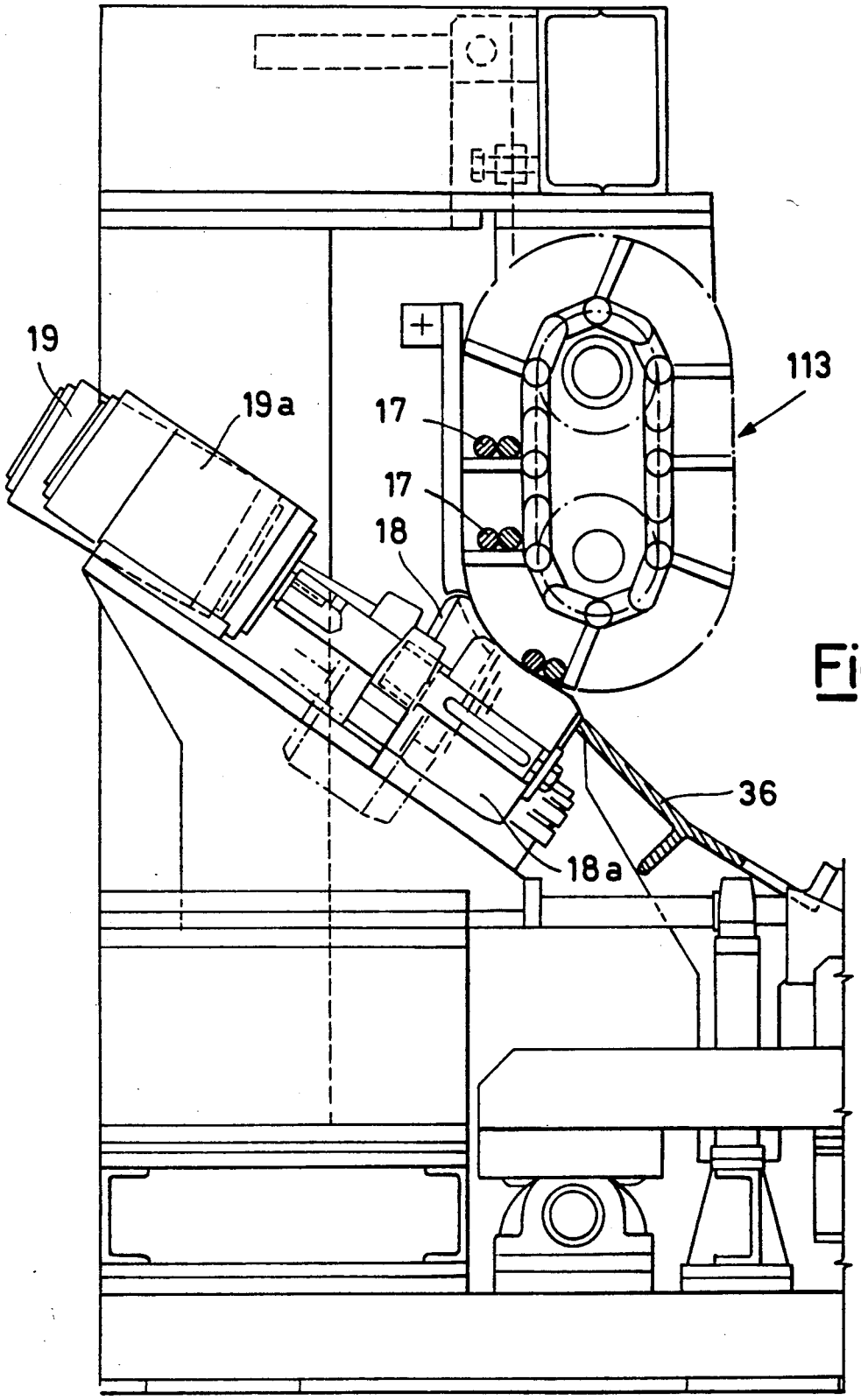

FIG. 11 shows a possible constructional variant.

DETAILED DESCRIPTION OF THE INVENTION

Referring to the drawings, the facility according to the present invention is structurally formed by the combination of at least one rotary shear 10, which performs the shearing to commercial length of the bar coming from the rolling mill, and of an apparatus 11 for braking and distributing the sheared bars onto conveyor means which perform the task of feeding said bars, while simultaneously cooling them, to devices which form, tie and store bar bundles.

Upstream the shear 10 a device 12 can be provided (FIG. 2), in order to perform the on-line thermal treatment of the bar coming from the finishing stand of the rolling mill; said device 12 is neither described nor illustrated in detail herein, in that it can be of a type known from the prior art, such as, e.g., the device which is the subject-matter of European patent application EU 82104193 of May 13, 1982.

Also the shear 10, which anyway is roughly illustrated and described herein, can be of known type, e.g., it can be similar to the shear which is the subject-matter of French patent 1,451,927, to which reference is made in case further clarifications are needed.

Referring in particular to FIGS. 1–4 of the attached drawings, the apparatus 11 is structurally constituted by a plurality of drums 13 arranged side-by-side to each other at short mutual distance, and keyed on a same shaft 14 which is operatively coupled with a drive motor means 15, which causes the drums to revolve in a stepwise fashion.

Each drum 13 has a plurality of chambers, or circumferential seats 16, inside the interior of each of which a bar 17 is received, which is already cut to a commercial length by the upstream shear 10.

With said drums 13 rolls 18, 18*a*—driven by respective motor means 19, 19*a*—cooperate (FIG. 2 and 3), which perform the task of causing the bars 17 to advance inside the interior of the chambers 16 of the same drums 13, and magnetic braking means 20 cooperate (FIG. 4), which perform the task of braking the bars 17 in order to make it possible for said bars to be discharged at the suitable speed and in the prefixed position onto the underlying conveyor means.

Of course, the magnetic braking devices 20 can be replaced by other means, suitable for the intended purpose, of mechanical type.

A mechanical braking action can be obtained by means of pairs of rolls, braking blocks, and so forth, or by means of natural friction along supporting planes.

The rolls 18 perform the task of driving the bars 17 before and after the shearing step, and the rolls 18*a* perform the task of causing the sheared bar 17 to advance inside the interior of said chamber 16 of said drums.

The above said conveyor means are constituted by a rack 21, followed by a chain conveyor means 22, under which blowers 23 (FIG. 1) can be installed, the purpose of which is of cooling the bars 17 sheared to commercial length.

Figure 5:
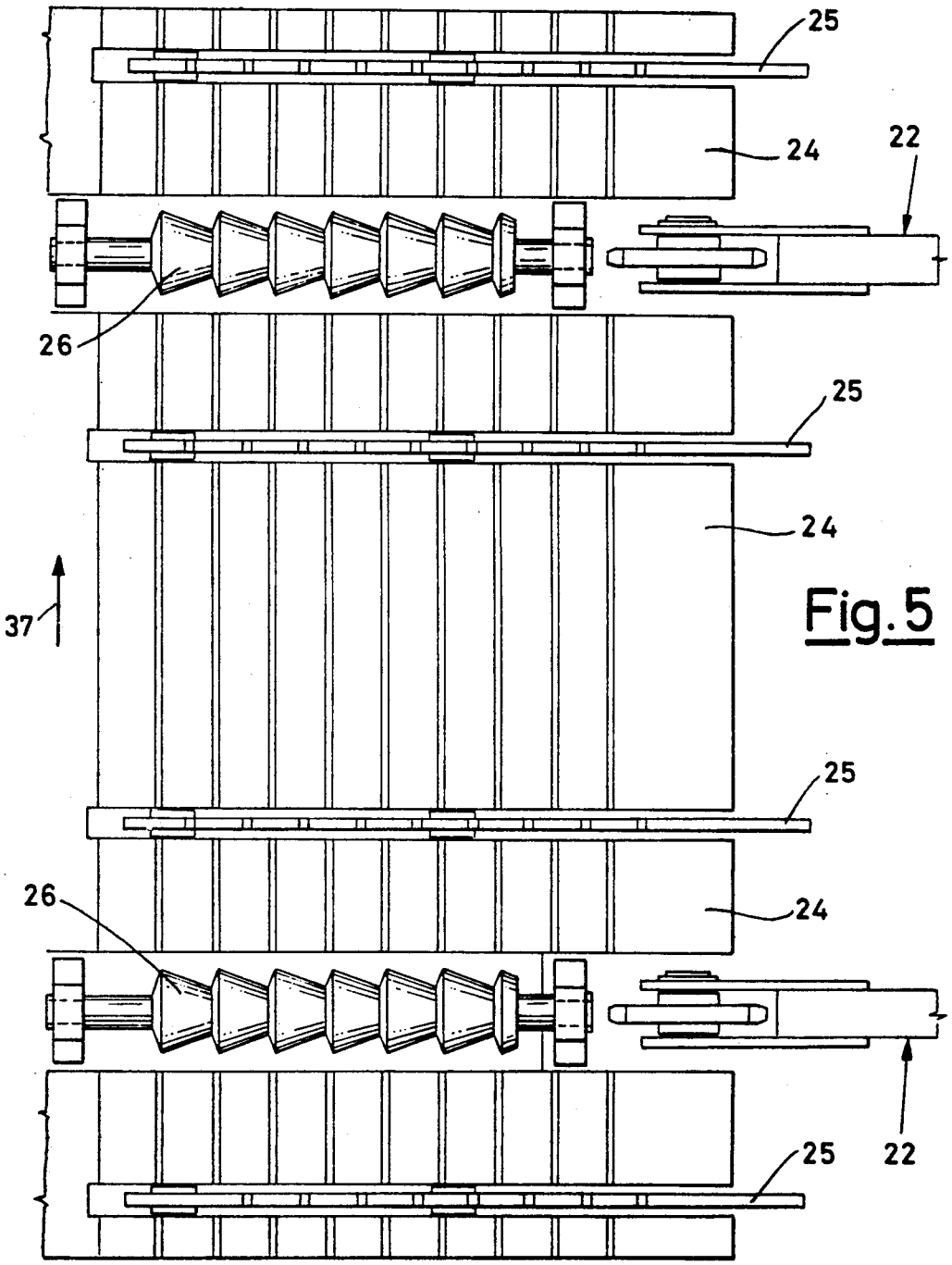
FIG. 5 shows a plan view of the rack by means of which the bars are transferred.
Figure 6:
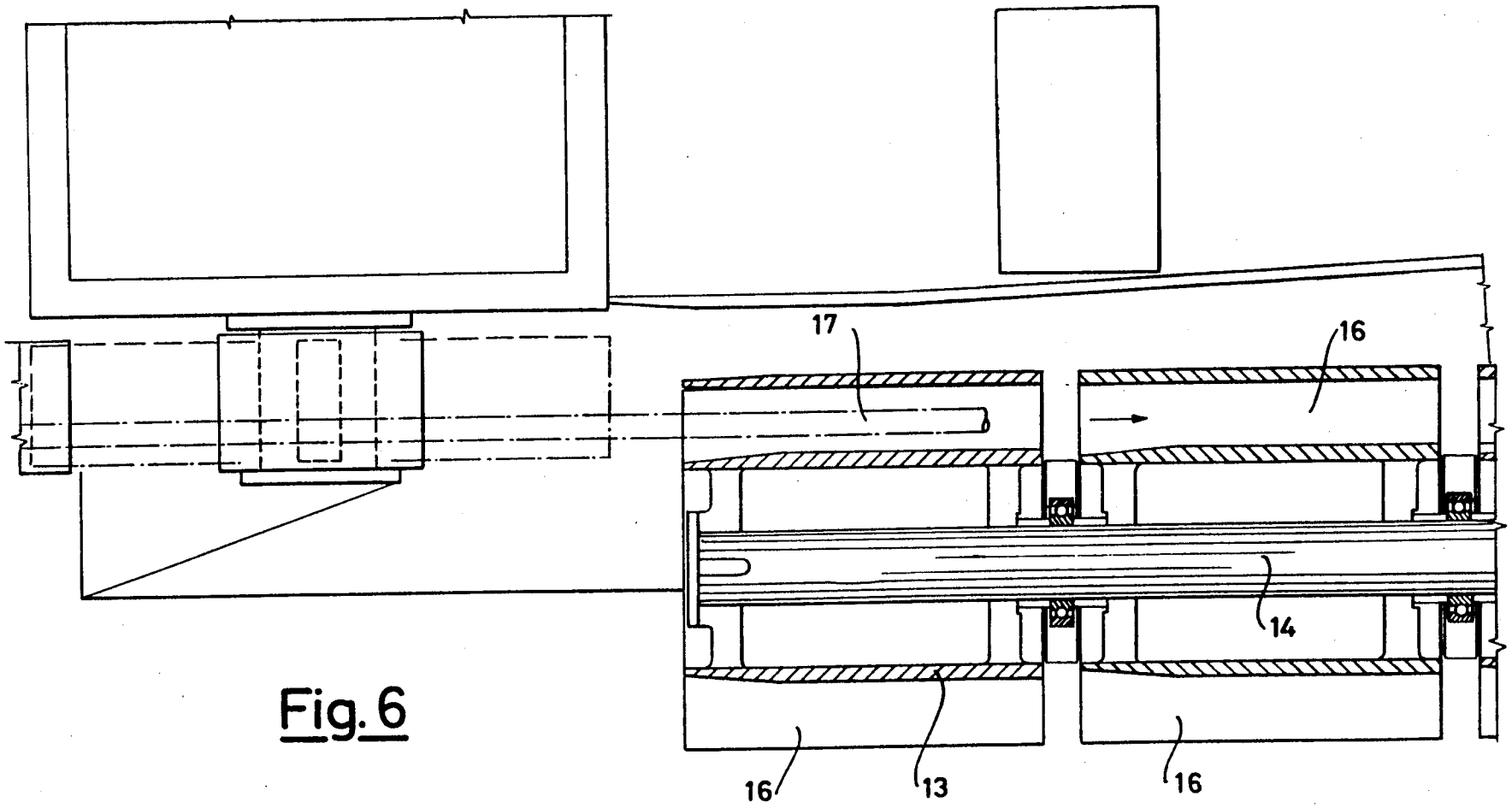
FIG. 6 shows a sectional view made according to the plane defined by path VI—VI shown in FIG. 1.

The rack 21 (FIGS. 1, 4 and 5) can be of the per se well-known type comprising a saw-teeth-shaped stationary bed 24, intersected by a set of mobile, also saw-teeth-shaped, rakes 25, and by a set of conical, motor-driven rolls 26, which are aligned with the chains 22 of the conveyor unit.

The rakes 25 are mounted on a framework 27 are driven to move by rotary movement in the direction of the arrow 28 thanks to a cam drive system 29.

The shear 10 (FIGS. 7–10) is structurally formed by a pair of blades 30, 31, i.e., respectively an upper blade 30 and a lower blade 31, mounted on revolutionary arms 32 which revolve around shafts 33.

The above disclosed facility operates as follows.

Figure 7:
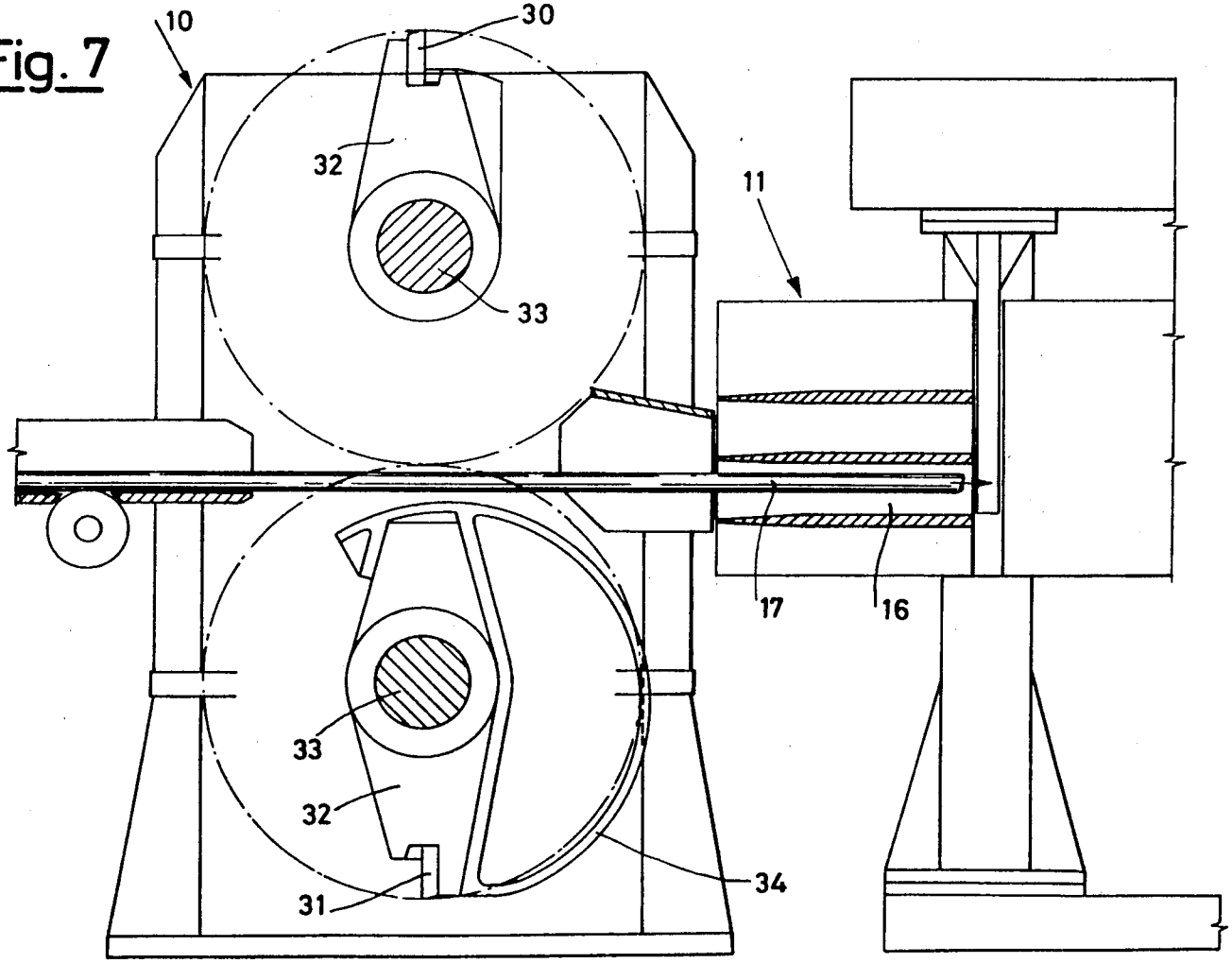
Figure 8:
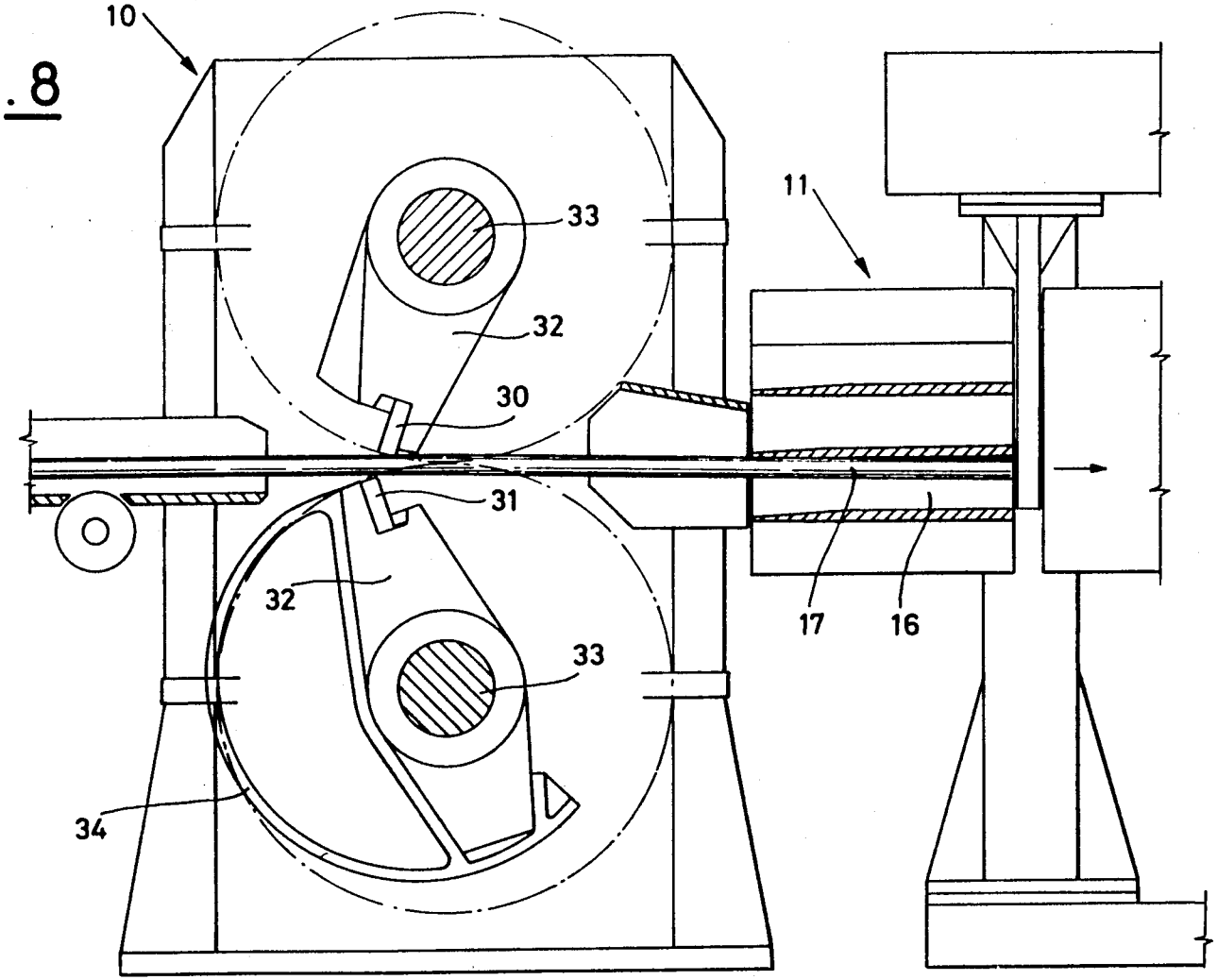
Figure 9:
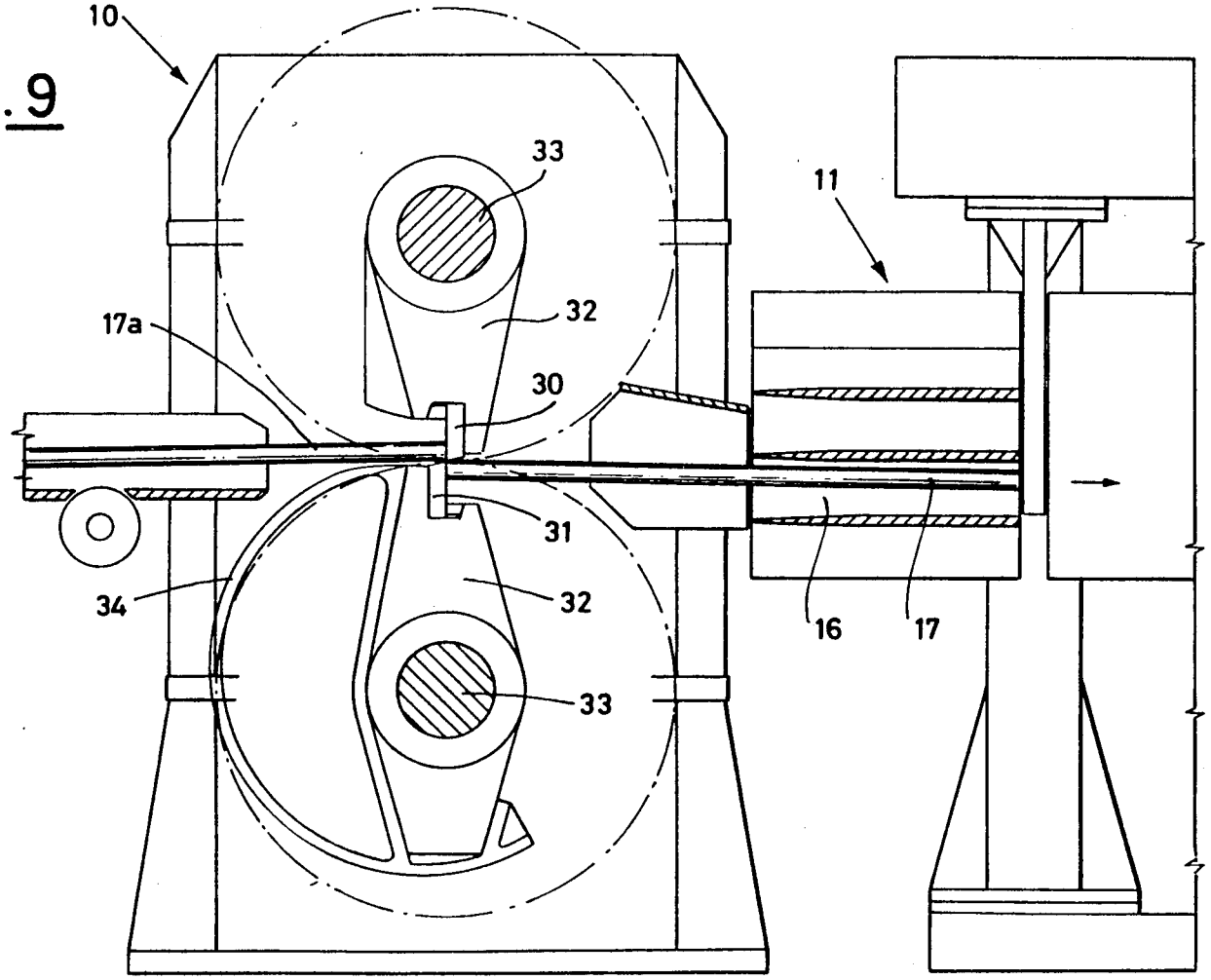

The blades 30, 31 of the shear 10 are kept normally stationary in their respective positions as shown in FIG. 7. When the shearing command signal is generated by a control processor (not shown), the blades start operating and reach the speed of the bar 17 before starting shearing it (FIG. 8).

When the shearing takes place (FIG. 9) the upper blade 30 lowers the trailing end of the sheared bar 17, and the lower blade 31 lifts the leading end of the successive incoming, bar 17*a*.

In that way, a first modification is obtained in the respective trajectories of the bar 17 sheared to commercial length, which is charged to one of the circumferential chambers 16 of the first drum 13, and of the bar 17*a* coming from the rolling mill.

Figure 10:
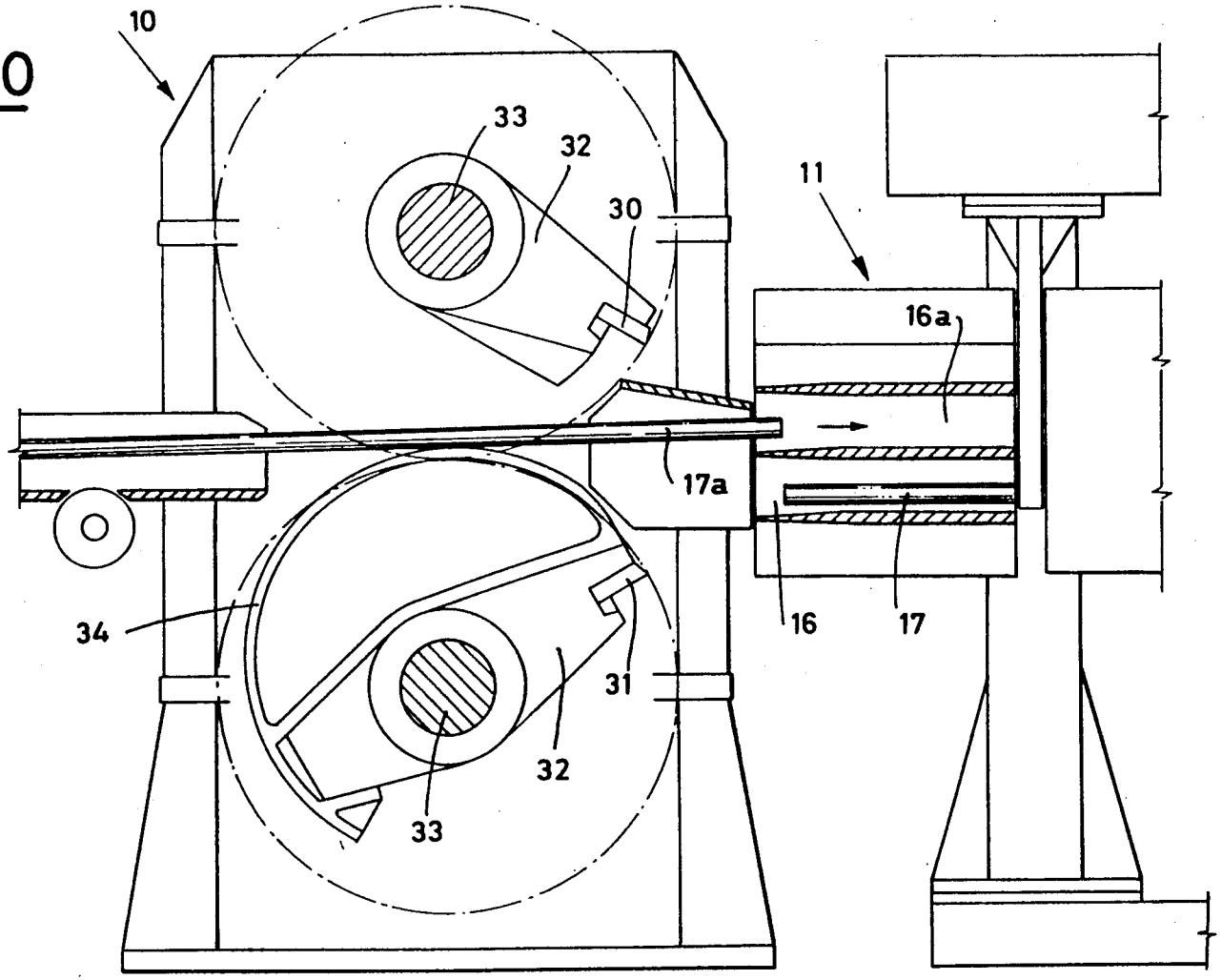

As shown in FIG. 10, a circular baffle 34 fastened to the arms 32 bearing the blades 31, causes the leading end of the bar 17*a* fed the rolling mill to further move upwards, until said leading end enters the circumferential chamber 16*a*, following the circumferential chamber 16, of the first drum 13.

The revolution of the blades 30, 31 and the revolution of the drum 13 take place in phase with each other, so that each bar sheared to commercial length is charged, in the above disclosed way, and as clearly illustrated in FIG. 7–10, in succession, to one of the circumferential chambers of the drum 13.

Figure 1:
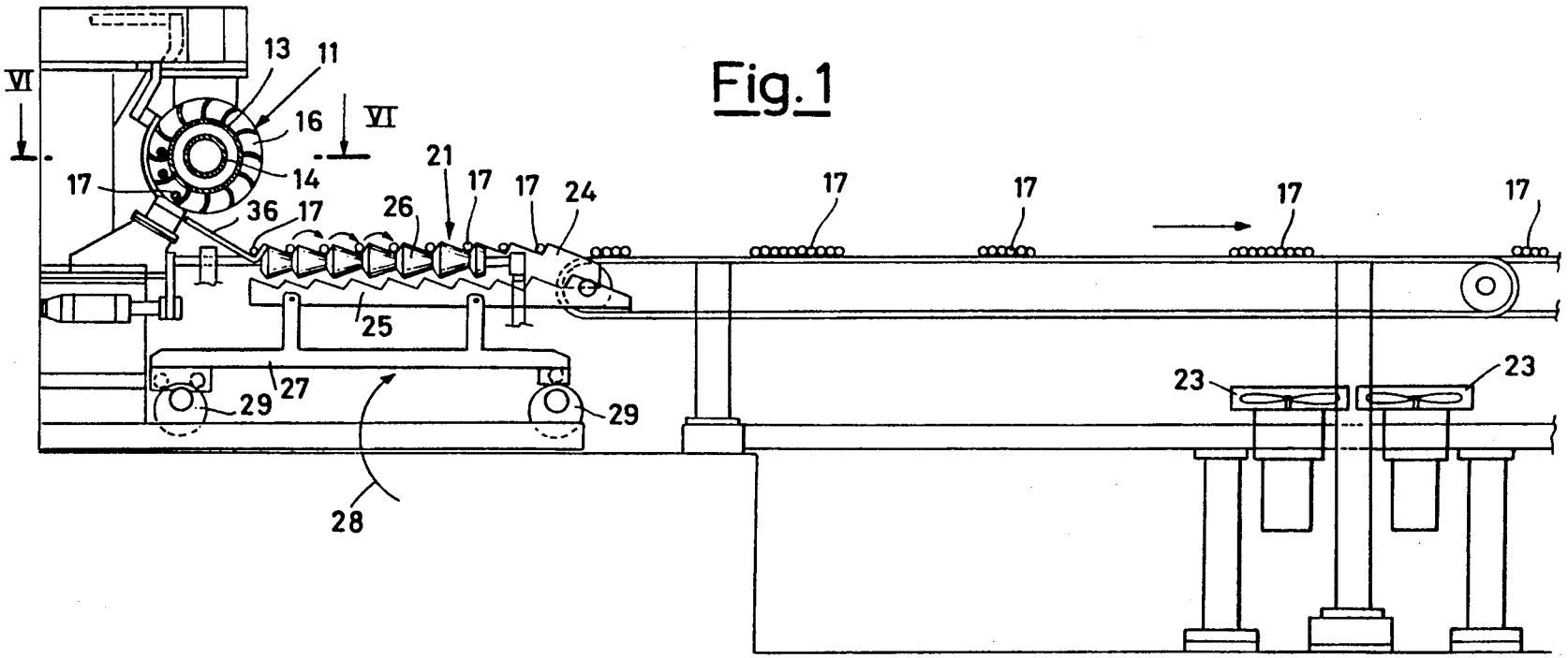
FIG. 1 shows a partially sectional elevation view which shows the facility according to the present invention.
Figure 2:
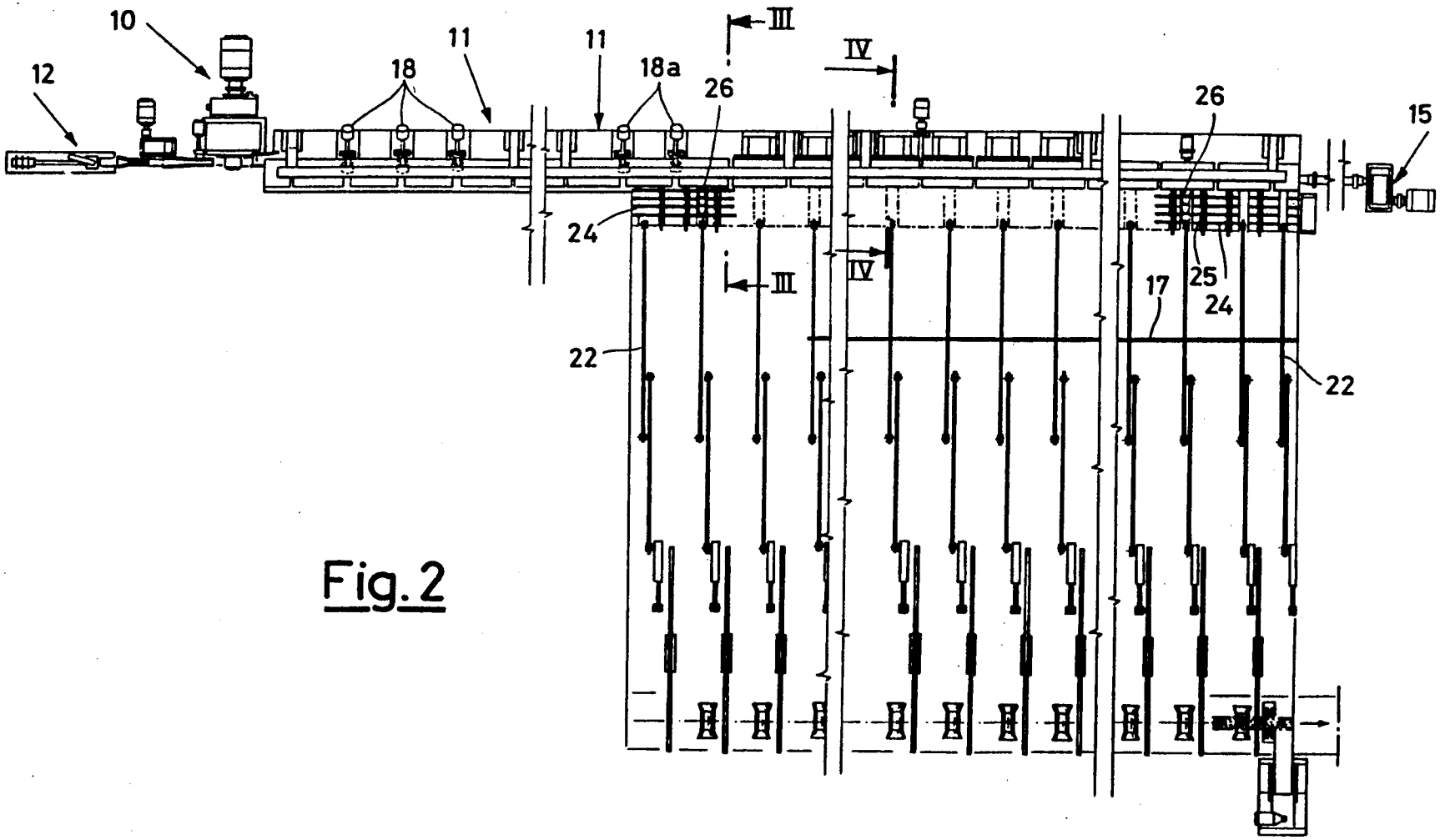
FIG. 2 shows a plan view.
Figure 3:
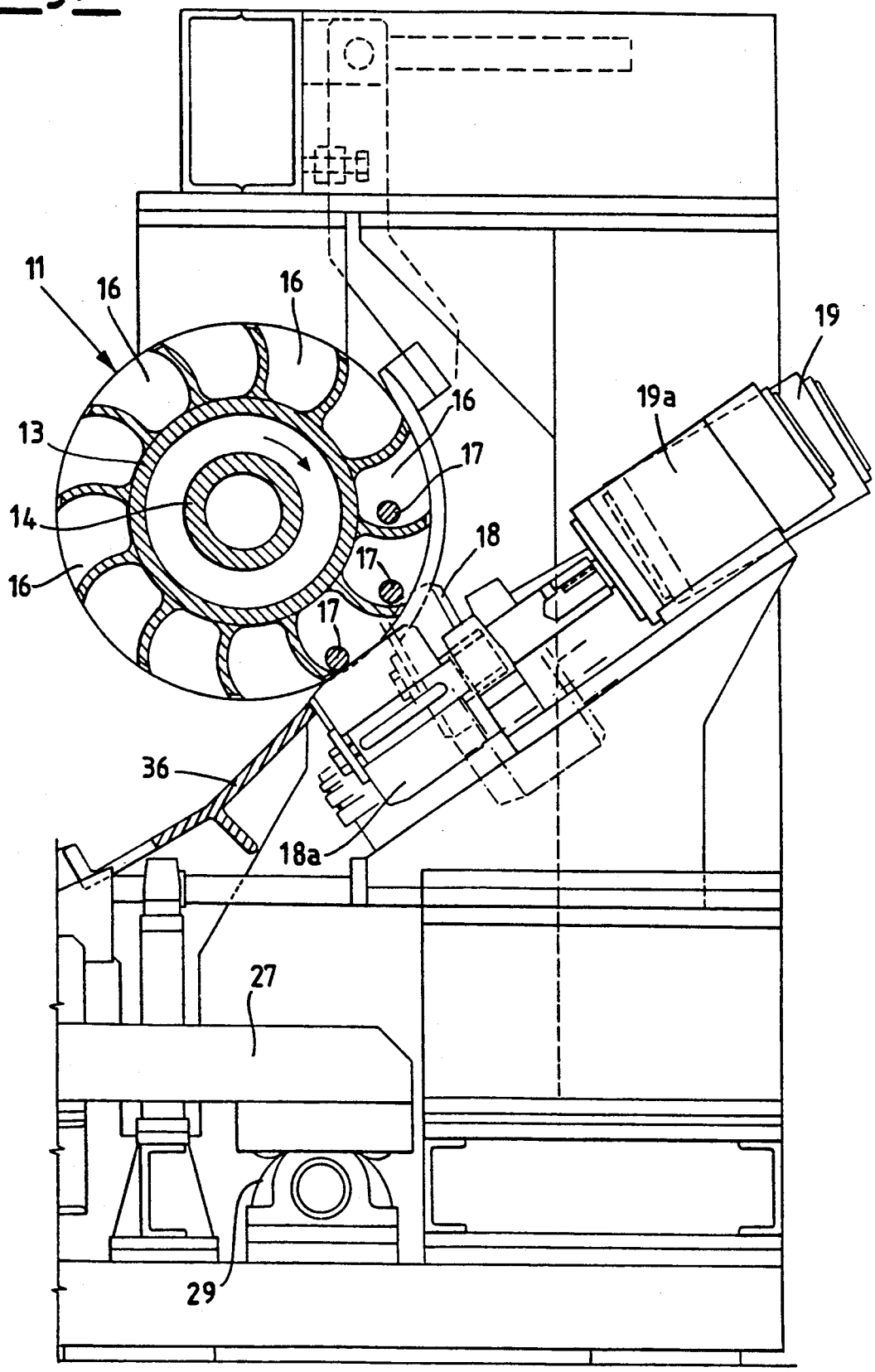
FIG. 3 shows a sectional view made according to the plane defined by path III—III shown in FIG. 2.
Figure 4:
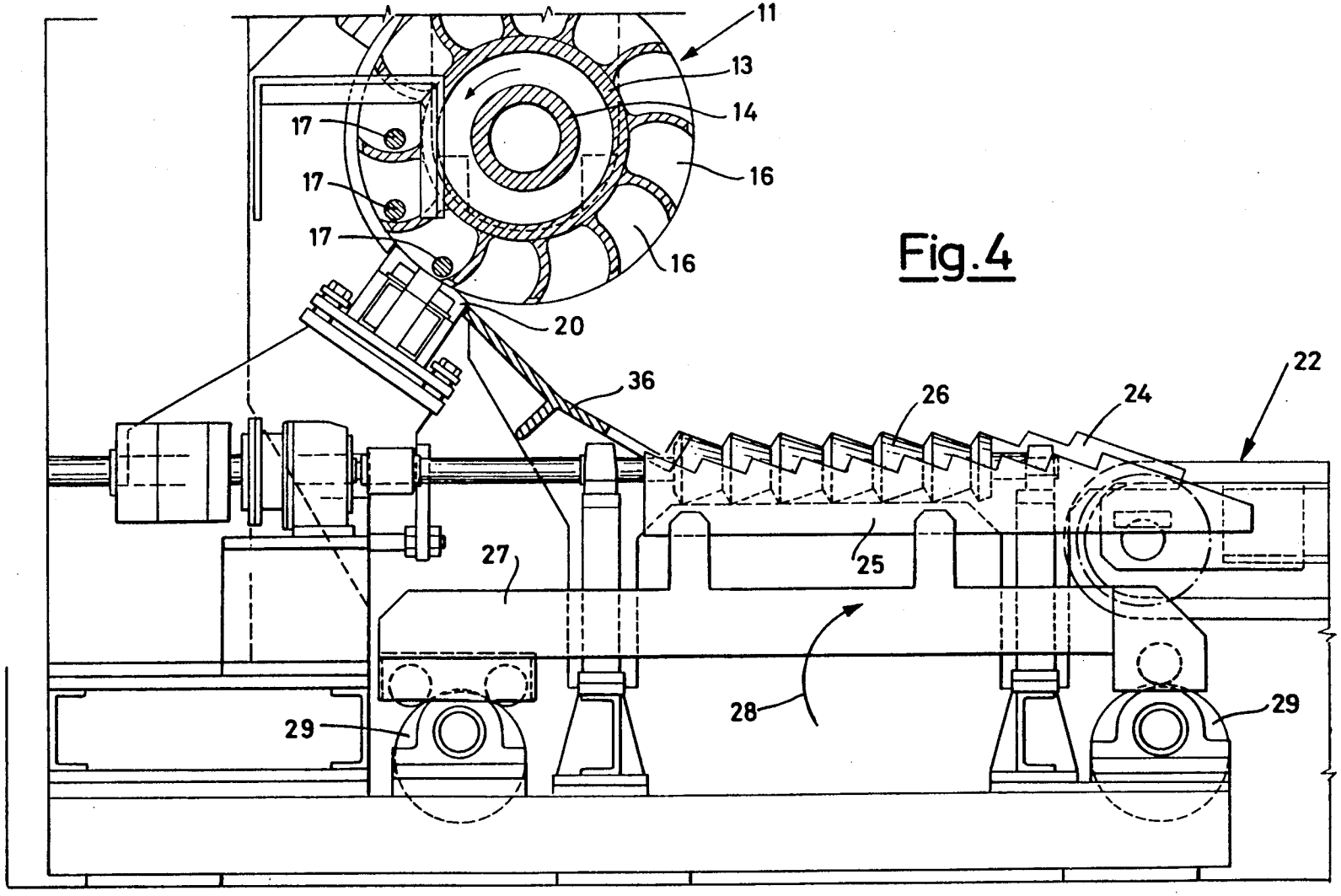
FIG. 4 shows a sectional view made according to the plane defined by path IV—IV shown in FIG. 2.

One will understand how at each shearing cycle a bar is consequently brought by the revolution of the drum 13 into engagement first with the drive rolls 18*a* and then with the braking magnets 20, which cause the same bar to decelerate in order that it can be discharged, through a chute 36, exactly on the saw-toothed rack 21 installed under the drums 13 in the region in which the discharging of the bars is planned to take place (FIG. 2).

The bars positioned on the rack 21 are advanced by the rolls 26 in the direction of the arrow 37 (FIG. 5) and are stepwise moved in the direction of the arrow 38, thanks to the eccentric revolutionary movement of the rakes 25, up to be engaged by the chain conveyor unit 22, which cause the same bars to advance first to the area of the blowers 23 and then towards the outlet end of the facility, where systems known from the prior art are provided in order to tie the same bars in bundle form, and to store said bar bundles.

To those skilled in the art, it will be clearly evident how the facility according to the present invention occupies a room which is considerably smaller than as occupied by the facilities of the types known from the prior art, in that the cooling bed and the feed table, which feeds the bars to it, are at all absent, thanks to the particular arrangement of the shear 10 which shears the bar to commercial length soon downstream the rolling mill and upstream the rotary-drums apparatus, which brakes the sheared bars and distributes them on a conveyor unit, which conveys said bars to the bundle-tying and bundle storing equipment; while it runs along the path from the shear to the facility outlet, the sheared bar will undergo an additional cooling owing to the action of surrounding air, or with the aid of the blowers 23.

The bar braking and distribution apparatus 11 as disclosed for merely exemplifying, non-limitative purposes, can be modified, without anyway departing from the scope of the present invention.

So, the drum 13 can be replaced, e.g. by a chain conveyor apparatus 113, of the type as schematically shown in FIG. 11. Furthermore, the drum 13, or the conveyor apparatus 113, can revolve counterclockwise rather than clockwise.

In order to shear the bars to length, also two shears arranged on-line can be provided. In that case, whilst with one single shear to one bar length one shearing cycle corresponds, when two shears are provided the shearing cycle takes place every two bar lengths.

Simultaneously, two or more bars can be sheared instead of one bar only (FIG. 11).

Finally, a braking/distributing apparatus could be also provided, in which the bars, instead of being moved vertically, as disclosed hereinabove, are moved horizontally.

The purpose declared in the preamble to the disclosure is thus achieved.

We claim:

1. An apparatus for continuously cutting steel bars from a rolling mill, which comprises:

a) at least one rotary shear in line with a rolled product exiting the rolling mill for shearing to commercial length the rolled product and forming a new leading edge on the rolled product;

b) at least one drum having a plurality of circumferential seats for continuously receiving in an axial direction the leading edge of the rolled product, which is rotated in phase with the shearing of the rolled product, to distribute onto a conveyor means the commercial length steel bars for downstream processing and to provide a new seat for receiving the new leading edge of the rolled product; and c) a braking means comprising drive rolls which face the interior of the circumferential seats.

2. An apparatus as defined in claim 1, wherein said conveyor means comprises a rack followed by a first chain conveyor unit having blowers thereunder.

3. An apparatus as defined in claim 1, further comprising bar-advanced rolls which cooperate with said drum to advance the bars inside the circumferential seat.

4. An apparatus as defined in claim 3, wherein said bar-advancing rolls face the interior of the circumferential seat.

5. A process for continuously cutting to commercial length steel bars coming from a rolling mill, which comprises:

a) feeding in an axial direction a rolled product from the rolling mill to a first of a plurality of circumferential collection chambers in a collecting drum;

b) shearing the rolled product to form a first bar of commercial length and a new leading edge on the rolled product;

c) braking the first bar of commercial length in phase with the shearing step of the first bar of commercial length, in the first of a plurality of collection chambers by drive rolls which face the interior of the collection chambers; and d) rotating the collection drum in phase with the shearing of the first bar and continuous feeding of the rolled product to introduce the new leading edge of the rolled product into a second of a plurality of collection chambers in the collecting drum and to distribute the first bar of commercial length onto conveyor means.

* * * * *